United States Patent [19]

Zaromb

[11] 4,257,855

[45] Mar. 24, 1981

[54] APPARATUS AND METHODS FOR THE ELECTROLYTIC PRODUCTION OF ALUMINUM METAL

[76] Inventor: Solomon Zaromb, 171 Clifton Ave., Newark, N.J. 07104

[21] Appl. No.: 924,817

[22] Filed: Jul. 14, 1978

[51] Int. Cl.[2] ..... C25B 11/03; C25C 3/06

[52] U.S. Cl. ..... 204/67; 204/245; 204/284; 204/285

[58] Field of Search ..... 204/67, 245, 284, 294, 204/285, 287, 286

[56] References Cited

U.S. PATENT DOCUMENTS

| | | | |
|---|---|---|---|
| 3,278,410 | 10/1966 | Nelson | 204/285 |
| 4,118,292 | 10/1978 | Fray et al. | 204/67 |

FOREIGN PATENT DOCUMENTS

| | | | |
|---|---|---|---|
| 183316 | 3/1958 | Sweden | 204/67 |
| 600034 | 3/1948 | United Kingdom | 204/67 |

*Primary Examiner*—Howard S. Williams

[57] ABSTRACT

An electrolytic cell for the production of aluminum metal comprises a permanent hollow anode structure of substantially corrosion-resistant material, with numerous perforations in the base of said structure, a packed bed of consumable carbon pieces supported by said base within the hollow space of said structure, means for heating said base so as to form a molten cryolite bath upon cell start-up, means for controllably cooling the walls of said anode structure to form a protective layer of frozen cryolite over said walls at the air-cryolite interfaces, means for adding fresh pieces of said consumable carbon to replenish said packed bed when a substantial portion thereof has been consumed, and means for adjusting the depth of immersion of said packed bed within said molten cryolite bath so as to reduce voltage and energy requirements or increase the rate of aluminum production.

18 Claims, 1 Drawing Figure

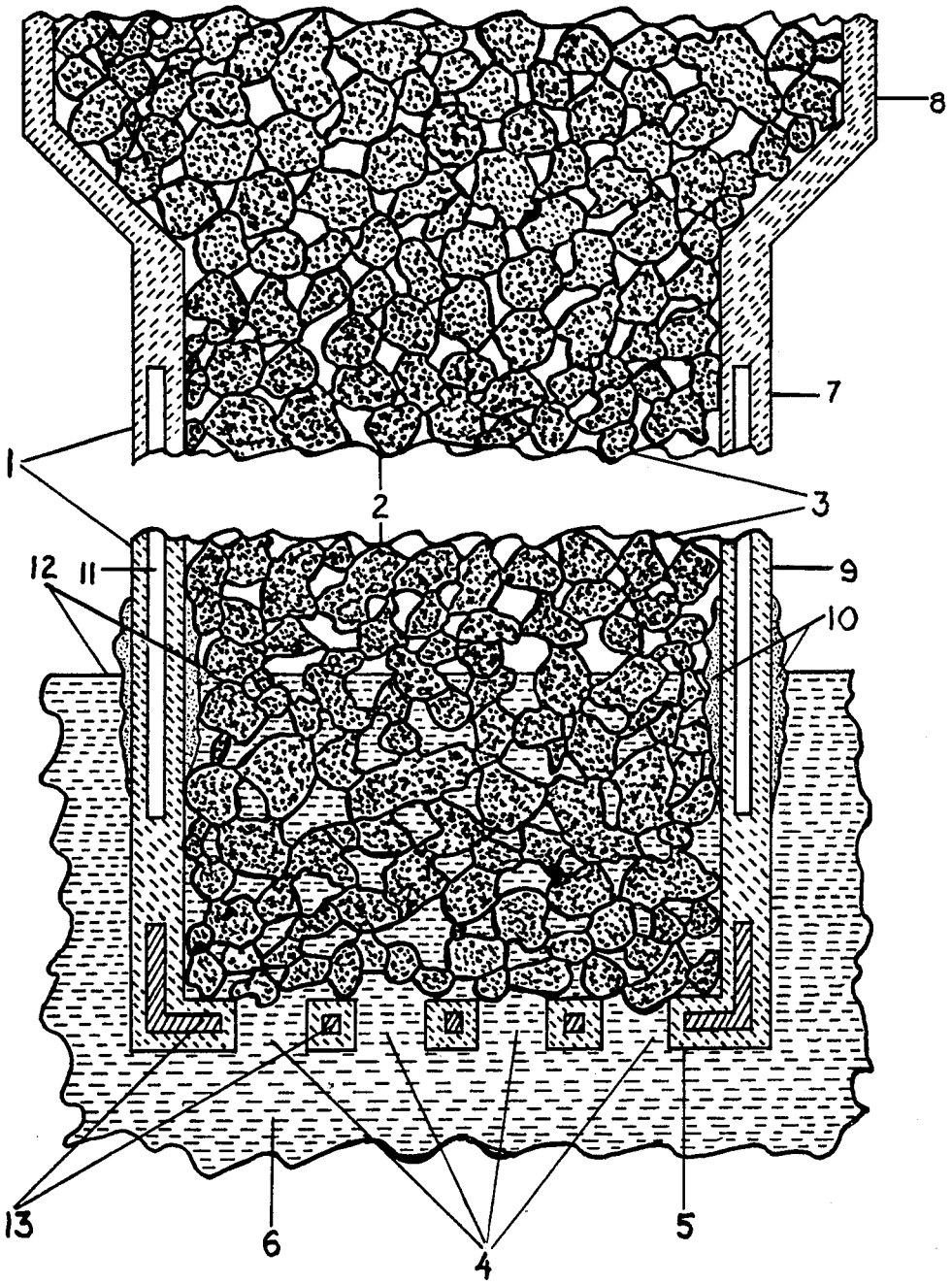
8
7
1
2
3
12
11
9
10
13
6
4
5

APPARATUS AND METHODS FOR THE ELECTROLYTIC PRODUCTION OF ALUMINUM METAL

BACKGROUND

This invention relates to improved apparatus and methods for supplying carbon to the electrolytic cells used in the production of aluminum metal.

In the present processes for the production of aluminum by electrolytic reduction of aluminum compounds, especially alumina, in a molten salt (especially cryolite) bath, the carbon anodes are gradually consumed, and must be periodically replaced, which entails substantial costs of labor and lost production time associated with the shutdown and startup necessitated by the anode replacement procedure. Moreover, the anode preparation, involving the use of special binders and baking procedures, adds substantially to the overall cost of aluminum production.

Attempts to develop permanent anodes of conductive oxide materials have failed because of the tendency of the oxides to dissolve in molten cryolite. Furthermore, a permanent anode which would not react with oxygen would necessitate a higher voltage input and hence a higher electrical energy consumption than the present anodes in which the reaction of carbon with oxygen helps to reduce the voltage and energy requirements.

SUMMARY OF THE INVENTION

It is an object of my invention to provide a permanent anode structure which would obviate the need for periodic replacements of anodes and eliminate the costs associated therewith.

It is a further object of my invention to provide a means of protecting said permanent anode structure from attack by the molten cryolite.

It is yet another object of my invention to permit the consumption of cheaper forms of carbon in the electrolytic production of aluminum, especially carbon free of special binders and special size and shape requirements.

It is still another object of my invention to reduce the anode polarization, and hence the overall voltage and energy requirements, of the electrolytic reduction process, by reducing the actual anode current density at the carbon-electrolyte interfaces, while maintaining the same total current, or aluminum production rate, as in present electrolytic cells of the same size. Alternatively, it is an object of my invention to permit a higher rate of aluminum production within the same electrolytic cells without exceeding the voltage requirements (and hence the energy consumption per pound of aluminum produced) of the present reduction process.

Briefly, my invention consists of the use of a permanent hollow anode structure of substantially inert material comprising a packed bed of consumable pieces of carbon, with numerous regularly distributed perforations in the base of said structure to permit electrolytic conductance between the cathode of the electrolytic cell and the packed-bed carbon anode, means for heating said base to effect melting of the cryolite bath during start-up, means for controllably cooling the walls of said anode structure so as to form a protective non-corroding layer of frozen cryolite over said walls near the air-cryolite interface, means for adding fresh pieces of said consumable carbon to replenish said packed bed when a substantial portion thereof has been consumed, and means for adjusting the depth of immersion of said packed bed within said cryolite bath.

BRIEF DESCRIPTION OF THE DRAWING

My invention may best be explained with the aid of the drawing, in which:

The FIGURE schematic partial view of a vertical cross-section of said packed-bed anode.

DESCRIPTION OF THE PREFERRED EMBODIMENT

As shown in the FIGURE, the packed-bed anode according to my invention comprises a hollow outer container 1, which may be either tubular or, preferably, having a square or rectangular horizontal cross-section conforming to the shape of the electrolytic cell (not shown), and a packed bed 2 of consumable carbon pieces 3 filling most of the hollow space within container 1. Perforations 4 through the base 5 of container 1 permit the molten cryolite bath 6 within the electrolytic cell to submerse the lower portion of bed 2 and thereby make electrolytic contact with the submersed pieces of carbon.

To avoid electrolytic attack of container 1, its lower portion 9, especially the portion in contact with molten cryolite, is preferably made of an electrically nonconductive refractory material, such as boron nitride or aluminum nitride. Furthermore, since the latter compounds are subject to corrosion when simultaneously exposed to both air and molten cryolite, they should be preferably protected near the air-cryolite interfaces by crusts of frozen cryolite 10. To assure the formation of such crusts, container 1 should be provided within its walls with cooling coils 11 through which a suitable cooling fluid, preferably ambient air, may be circulated at an appropriate rate (i.e., a rate sufficient to maintain a crust over the susceptible portions of container 1, while leaving most of the surface 12 of the cryolite bath in a molten state).

Also contained within the lower portion of container 1, especially within the base 1, is a resistive heating element 13 serving to melt the cryolite within the electrolytic cell during startup. If properly designed, the same heating element should preferably also serve to structurally reinforce the base 5 so that the latter would be sure to withstand the weight of the bed 2.

Of course, to minimize ohmic losses, the total horizontal cross-sectional area of the perforations 4 in base 5 should be as large as feasible, and the thickness of base 5 as small as practicable.

On the other hand, the upper portion 7 of container 1 which is in contact with the carbon pieces but not with the molten cryolite is preferably made of an electronically conductive refractory material such as silicon carbide or heavily doped boron nitride. Current from a positive voltage terminal (not shown) may then be supplied through said electronically conductive material to the packed bed 2 and thence through the molten salt bath to the cathode (not shown) of the electrolytic cell. Furthermore, said upper portion 7 may be enlarged near the top to merge with a hopper 8 serving to store and feed the carbon pieces 3. Also affixed to the upper portion 7 may be several supports (not shown) capable of maintaining the container 1 at an appropriate height within the electrolytic cell.

Once said height is fixed, the depth of immersion of the packed bed 2 in the molten cryolite bath 6 is determined chiefly by the amount of cryolite added to the cell from a cryolite supply means (not shown). For best results, the level 12 of the molten bath should be adjusted so as to yield the desired production rate at a minimum applied voltage or energy input. As is evident from the FIGURE, an increased depth of immersion increases the area of carbon in contact with the molten bath, thereby decreasing the actual anodic current density (for a fixed total current) and hence the anodic overvoltage. However, the average ionic current path length through the electrolyte must also increase with increased immersion, thereby giving rise to increased ohmic losses and/or to negligible contributions to the overall current from the uppermost submersed pieces of carbon. The optimum depth of immersion should therefore correspond to either the point where any further decrease in anode polarization is offset by increased ohmic losses or to the point where the heat generation rate near the surface 12 of the cryolite bath becomes insufficient to maintain the surface layers in a molten state.

There will now be obvious to those skilled in the art many modifications and variations of the afore-disclosed embodiment which, however, shall not deviate from the scope of my invention if defined by the following claims:

I claim:

1. A cell for the Electrolytic reduction of aluminum compounds to produce aluminum metal comprising a hollow anode structure made of substantially corrosion resistant materials, said structure comprising numerous openings through its base and being adapted to contain a packed bed of electrochemically consumable carbon pieces within its hollow space and supported by said base, and means for adding fresh pieces of said consumable carbon to replenish said packed bed after some of its carbon has been electrochemically consumed.

2. Electrolytic cell as claimed in claim 1 comprising means for heating said base so as to effectuate melting of a cryolite bath within said electrolytic cell during start-up of aluminum production.

3. Electrolytic cell as claimed in claim 2 wherein said heating means is an ohmic resistance element.

4. Electrolytic cell as claimed in claim 3 wherein said heating means is a structurally firm element reinforcing the structure of said base.

5. Electrolytic cell as claimed in claim 1 wherein the lower portions of said hollow anode structure and of said packed bed are immersed in a molten salt bath, and wherein the immersed lower portion of said hollow anode structure is made of an electrically nonconductive material substantially resistant to corrosion in said molten bath.

6. Electrolytic cell as claimed in claim 5 wherein said electrically nonconductive material comprises boron nitride or aluminum nitride.

7. Electrolytic cell as claimed in claim 5 comprising means for controllably cooling the walls of said hollow anode structure so as to form a protective crust of frozen salt covering said walls near the salt-air interfaces.

8. Electrolytic cell as claimed in claim 10 wherein said cooling means comprises a fluid circulating within said walls.

9. Electrolytic cell as claimed in claim 8 wherein said fluid is air.

10. Electrolytic cell as claimed in claim 5 comprising means for adjusting the depth of immersion of said packed bed in said molten salt bath.

11. Electrolytic cell as claimed in claim 1 wherein an upper portion of said hollow anode structure which is not exposed to molten cryolite is made of a substantially corrosion-resistant electronically conductive material providing an electrical connection between a positive applied voltage terminal and said packed bed of carbon.

12. Electrolytic cell as claimed in claim 11 wherein said conductive material is silicon carbide or heavily doped boron nitride.

13. A method of supplying consumable carbon anode material to an aluminum-producing electrolytic cell, which comprises:

(a) causing pieces of electrochemically consumable carbon to drop into a permanent hollow anode structure so as to form a packed bed of carbon within said structure;

(b) causing a lower portion of said anode structure and of said packed bed to be submersed in a molten salt bath of said electrolytic cell; and (c) causing electric current to flow from said permanent structure to said packed bed and thence through said molten salt bath to the cathode of said electrolytic cell so as to form aluminum metal near said cathode.

14. A method as claimed in claim 13 which comprises the preliminary step of heating the base of said permanent anode structure so as to cause melting of the salt bath during start-up of said electrolytic cell.

15. A method as claimed in claim 14 wherein said heating step is effected by passing electric current through a resistive element contained within said base.

16. A method as claimed in claim 13 which comprises cooling the walls of said permanent anode structure so as to form a crust of frozen salt over said walls near the air-salt interface, thereby protecting said walls from corrosion by the combined action of air and molten salt.

17. A method as claimed in claim 16 wherein said cooling is effected by circulating ambient air within the susceptible portions of said walls.

18. A method as claimed in claim 13 which comprises adjusting the depth of immersion of said packed bed within said salt bath so as to either reduce the voltage and energy requirements or increase the production capacity of said electrolytic cell.

* * * * *